US005354475A

United States Patent [19]

Bakker

[11] Patent Number: 5,354,475

[45] Date of Patent: Oct. 11, 1994

[54] PROCESS FOR SEPARATING POLAR AND NON-POLAR CONSTITUENTS FROM COAL TAR DISTILLATES

[75] Inventor: Hendrik J. Bakker, Weesp, Netherlands

[73] Assignee: Cindu Chemicals B.V., Uithoorn, Netherlands

[21] Appl. No.: 86,353

[22] Filed: Jul. 1, 1993

Related U.S. Application Data

[63] Continuation of Ser. No. 732,654, Jul. 18, 1991, abandoned.

[51] Int. Cl.[5] ..... B01D 15/08

[52] U.S. Cl. ..... 210/656; 210/635; 208/177; 208/322; 208/329; 208/337; 585/825; 585/864; 585/866; 585/867

[58] Field of Search ..... 208/177, 322, 329, 337; 210/635, 656, 659, 198.2; 585/825, 864, 866, 867

[56] References Cited

U.S. PATENT DOCUMENTS

| | | | |
|---|---|---|---|
| 3,701,609 | 10/1972 | Bailey | 210/198.2 |
| 4,116,046 | 9/1978 | Stein | 210/198.2 |
| 4,806,250 | 2/1989 | Takata | 210/198.2 |
| 4,935,145 | 1/1990 | Cortes | 210/656 |
| 4,940,548 | 7/1990 | Zinnen | 210/198.2 |
| 4,992,621 | 2/1991 | Zinnen | 585/828 |
| 5,019,271 | 5/1991 | Zinnen | 210/198.2 |

FOREIGN PATENT DOCUMENTS

| | | | |
|---|---|---|---|
| 3114346 | 10/1982 | Fed. Rep. of Germany | 210/198.2 |
| 1384538 | 2/1975 | United Kingdom | 210/198.2 |
| 2096637 | 10/1982 | United Kingdom | 210/198.2 |

OTHER PUBLICATIONS

Snyder, Introduction to Modern Liquid Chromatography, John Wiley, 1979, pp. 103–105, 257–260, 663–668, and 691.

Franck et al., Steinkohlenteer, Springer-Verlag Berlin Heidelberg New York 1968, pp. 60–65 and 76–81.

*Primary Examiner*—Ernest G. Therkorn

*Attorney, Agent, or Firm*—Michael N. Meller

[57] ABSTRACT

A process for separating polar and non-polar constituents from coal tar distillates, comprising passing the distillates over a separation column together with an eluting agent. According to the invention the process comprises mixing a tar oil distillate with a non-polar solvent, passing this mixture over a separation column which contains a stationary phase and eluting with a non-polar solvent, the eluting agent being collected together with the substances dissolved therein, followed by eluting with a more polar eluting agent or with a plurality of eluting agents of increasing polarity, and separately collecting the more polar eluting agent or the plurality of eluting agents of increasing polarity, together with the substances dissolved therein, followed by isolating the substances dissolved in the non-polar and in the polar solvents, respectively, utilizing known techniques.

10 Claims, 1 Drawing Sheet

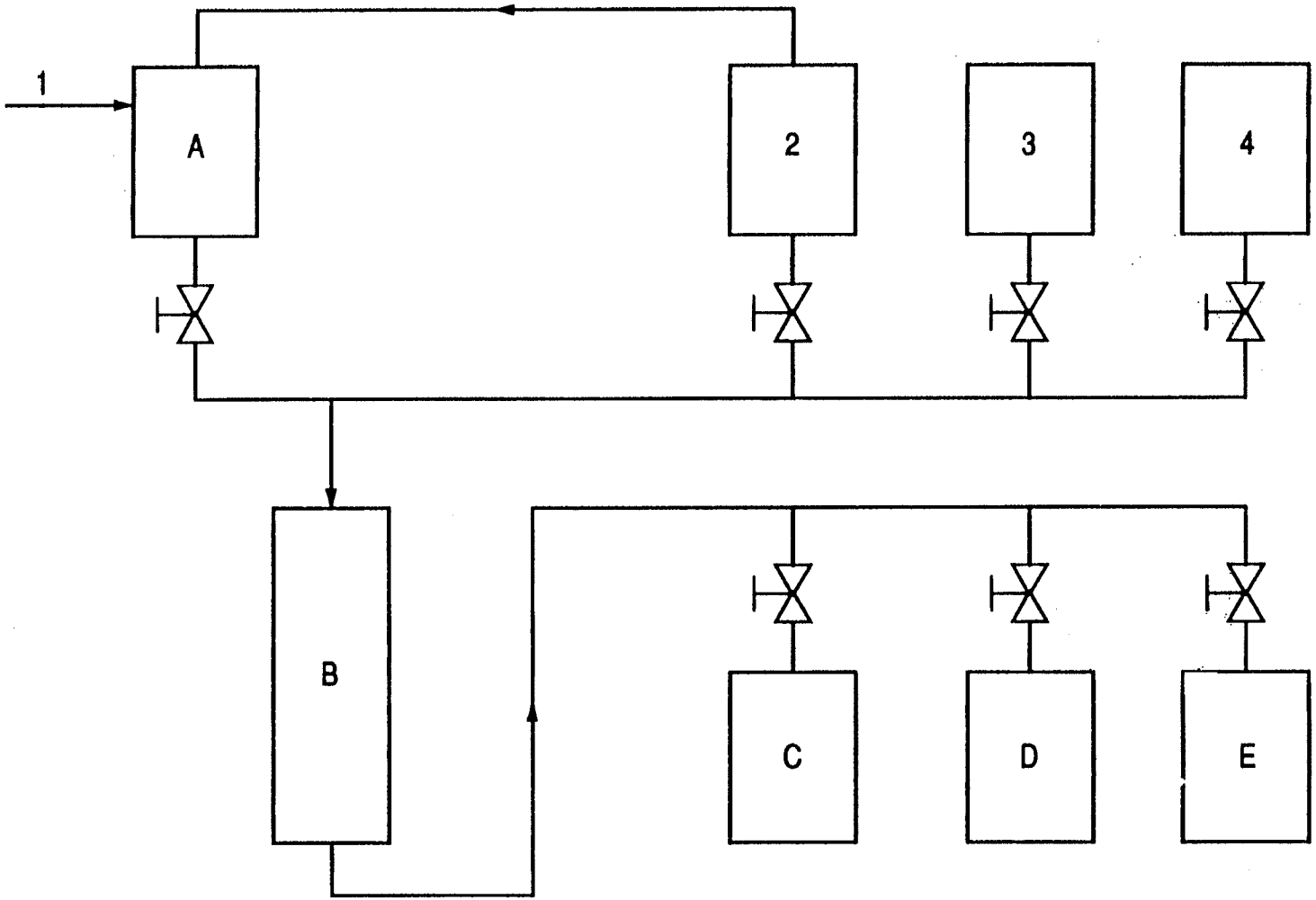
1
A
2
3
4
B
C
D
E

PROCESS FOR SEPARATING POLAR AND NON-POLAR CONSTITUENTS FROM COAL TAR DISTILLATES

This application is a continuation, of application Ser. No. 732,654, filed Jul. 18, 1991, now abandoned.

The invention relates to a process for separating polar and non-polar constituents from coal tar distillates.

Coal tar distillates, and particularly the fraction thereof which distills up to 260° C., form an important source of valuable nitrogen-containing heterocyclic compounds, in particular pyridine and its derivatives, including picolines, quinoline derivatives and indoles.

It is known to obtain these compounds by employing extraction processes or fractional distillation (cfr. H. Frank, G. Collin, Steinkohlenteer, Springer Verlag, Berlin 1968). However, such a process is technically complicated and a great number of reaction steps are required to achieve a certain degree of separation of said compounds.

In German Offenlegungsschrift 31 14 346, a process is proposed for obtaining nitrogen-containing aromatic hydrocarbons from aromatic hydrocarbon mixtures, particularly tar oil fractions. According to the process described, aromatic hydrocarbon mixtures are homogenized with a porous inorganic carrier material, such as aluminium oxide or silica gel, whereafter the mixture is applied to a separation column and eluted at a pressure of 1–30 bar, thus yielding a nitrogen-lean and a nitrogen-rich fraction. For the elution, at least two eluting agents are used, which are used one after another, and the elution occurs at a temperature which is just below the boiling points of the respective eluting agents. After the elution, the carrier material is thermally regenerated, so that a still considerable amount of the nitrogen-rich fraction can be obtained. As eluting agents, in particular n-hexane and toluene are proposed.

Apart from the fact that the process described is relatively expensive and cannot be carried out continuously owing inter alia to the mixing step and the necessary thermal regeneration of the carrier material, hardly any separation occurs between the compounds present in the nitrogen-rich fraction, because the elution is carried out with eluting agents that hardly differ in polarity.

The basis of the present invention is the insight that by employing eluting agents of increasing polarity, coal tar distillates can be separated in different fractions, depending on the polarity of the different constituents in those fractions. It has been found that this not only enables far-reaching fractionation, but also permits the separation to be carried out continuously and at a low temperature and pressure, while a thermal regeneration of the absorbent is not necessary.

According to the invention, a coal tar distillate is mixed with a non-polar solvent and passed over a separation column which comprises a stationary phase. Then elution is performed-with a non-polar solvent, which my be the same as that with which the coal tar distillate was mixed earlier. Thus, the non-polar aromatic hydrocarbons present in the distillate are eluted, while the polar compounds remain behind on the absorbent. Then elution is carried out with a more polar eluting agent or with a plurality of eluting agents of increasing polarity, so that the more polar fractions are obtained. Finally, the column is regenerated by running the non-polar eluting agent through again, whereafter the cycle is repeated. By fractional distillation the non-polar and the polar compounds, respectively, are separated from the non-polar and the polar eluting agents, respectively.

Although for the elution with the more polar eluting agent a single solvent of a polarity which differs strongly from the non-polar solvent can be used, preferably elution is carried out with a plurality of solvents of increasing polarity. Thus, during elution already a separation is obtained within the adsorbed polar fractions, so that the later separation by means of fractional distillation of the polar eluting agent is less complicated.

In order to employ as few substances as possible in the elution, for the composition of the more polar solvent one preferably starts from the non-polar solvent, to which successively increasing amounts of a polar solvent are added.

In principle, the choice of the non-polar solvent is not critical, as long as it mixes well with the coal tar distillate and lowers the polarity of the coal tar distillate to a sufficient degree. Suitable solvents are, in particular, aromatic and aliphatic hydrocarbons which may or may not be substituted (with substantially non-polar groups), the choice thereof being determined chiefly by economic considerations. Examples of suitable non-polar solvents are benzene, toluene, n-pentane, n-hexane, n-octane or cyclohexane.

The more polar solvent, which is employed alone or, preferably, together with the non-polar solvent, must satisfy different requirements, certainly in the latter case.

Thus, it must be polar in such a way that together with the non-polar solvent a wide range of increasing polarity can be obtained. Further, it must mix well with the non-polar solvent and have a boiling point that is sufficiently different from the eluted polar compounds. Furthermore, it should not form an azeotrope with those eluted compounds.

Examples of suitable polar liquids which are used together with the non-polar eluting agent described hereinabove, are the following:

- esters, such as ethyl acetate and propyl acetate;
- halogenated hydrocarbons such as methylene chloride, chloroform, and dicholoroethane;
- ethers, such as tetrahydrofuran and dioxane;
- nitriles, such as acetonitrile;
- alcohols, such as methanol, ethanol, and n- or i-propanol.

In the process according to the invention, the conventional, particularly inorganic, stationary phases can be used. Examples of suitable stationary phases are silica gel or acid, alkaline or neutral alumina. Preferably, the grain size of the stationary phase is between 60 and 200 micron.

BRIEF DESCRIPTION OF THE DRAWING

The sole FIGURE shows a schematic diagram of the process according to the invention.

DESCRIPTION OF THE PREFERRED EMBODIMENTS

With reference to the drawing, which diagrammatically illustrates the process according to the invention, a preferred embodiment thereof will now be further explained.

In container A or the like, coal tar distillate 1 is mixed with a non-polar solvent 2. The mixing ratio can vary from 10–50% by volume of distillate, based on the solvent. An amount of the distillate/non-polar solvent is applied to a column of the stationary phase B, which has been packed in known manner, preferably using the same non-polar solvent as that which the coal tar distillate was mixed with. The charge of the column is variable, but is generally 5–60%, calculated on the mass of the stationary phase in the column and based on the amount of the original, i.e. unmixed, distillate.

Then the non-polar aromatic hydrocarbons are eluted with the same non-polar solvent 2 and collected in reservoir C.

Then the polar constituents, particularly heterocyclic nitrogen and sulfur compounds and phenol derivatives, are eluted with different mixtures of the non-polar solvent and polar solvents that may or may not be the same, present in reservoirs 3 and/or 4, and collected in vessels D and E. It will be clear that when elution is carried out with a plurality of solvent mixtures of increasing polarity, various, different, fractions can be collected in extra reservoirs (not shown).

In the process according to the invention, generally the ratio of non-polar to polar solvents can vary from 9:1 to 0:1.

After the total elution of the material charged, the column is washed with an amount which is generally about 3-fold that of the so-called "void volume" of an non-polar solvent, so as to regenerate the column and prepare it for the next charge of distillate.

The process according to the invention, including the regeneration of the column, is carried out at a temperature of between 20°–50° C.

Of the fractions C, D, and E obtained, the solvent is distilled off for reuse and the substances thus obtained are further processed using known techniques such as distillation and/or crystallization. The invention is further illustrated in and by the following examples.

EXAMPLE 1

A coal tar distillate (3 g), which contains 16% tar bases, is diluted with cyclohexane (1:1 v/v) and applied to a column of alumina (15 g, act. III, neutral). Elution with cyclohexane (40 ml) resulted, after distillation of the cyclohexane, in a fraction of neutral aromatic hydrocarbons (2.49 g) with a yield of 83% relative to the starting distillate, and which fraction contains less than 0.1% tar bases. Elution with 1:1 cyclohexane/ethyl acetate (40 ml) resulted, after distillation of the eluent, in a fraction of tar bases (0.46 g) with a yield of 15% relative to the starting distillate, which fraction contained less than 0.1% aromatic hydrocarbons.

The column was regenerated for reuse with cyclohexane (40 ml), whereafter the cycle was repeated, with equal results.

EXAMPLE 2

A coal tar distillate/cyclohexane mixture, as specified in Example 1, was applied to a column of silica gel (15 g) . Elution with cyclohexane and with cyclohexane/-propyl acetate (1:3), in the manner as described in Example 1, resulted in a fraction of aromatic hydrocarbons (2.50 g) with a yield of 83% relative to the starting distillate, and in a fraction of tar bases (0.47 g), with a yield of 15.7% relative to the starting distillate. The aromatic hydrocarbons contained less than 0.1% tar bases and the tar base fraction less than 0.1% hydrocarbons.

After regeneration with cyclohexane (40 ml), the cycle was repeated many times, with equal results.

EXAMPLE 3

A tar coal distillate (36 g), which contained 16% tar bases, was mixed with cyclohexane (1:1 v/v) and applied to a column of silica gel (60 g).

Elution with cyclohexane (300 ml) resulted, after distillation of cyclohexane, in a fraction of aromatic hydrocarbons (29 g), with a yield of 81% relative to the starting distillate and a tar base content of less than 0.1%.

Elution with 1:3 cyclohexane/propyl acetate (300 ml) resulted, after distillation of the eluent, in a fraction of tar bases (5.5 g), with a yield of 15.3% relative to the starting distillate and a hydrocarbon content of 0.25%. Regeneration of the column with cyclohexane, as described earlier, was carried out with 250 ml, whereafter the cycle was repeated many times with equal results.

EXAMPLE 4

As described in Example 3, coal tar distillate (36 g), which contained 5% indole and 11% quinoline derivatives, was applied to a silica gel column (60 g). The aromatic hydrocarbons were eluted as described in Example 3, with equal results.

Elution with methylene chloride (300 ml) resulted, after distillation of the solvent, in a fraction of indole (1.7 g and purity 96%) with a yield of 4.7% relative to the starting distillate.

Further elution with 3:1 methylene chloride/ethyl acetate (300 ml) resulted, after distillation of the eluent, in a fraction of quinoline derivatives (3.8 g), with a yield of 10.5% relative to the starting distillate and an indole content of 1.3%.

The column was regenerated as described earlier (Example 2) and the cycle was repeated many times, with equal results.

EXAMPLE 5

As described in Example 3, a coal tar distillate (36 g) , which contained 5% indole and 11% quinoline derivatives, was applied to a silica gel column (60 g). The aromatic hydrocarbons were eluted as described in Example 3.

Elution with 4:1 cyclohexane/ethyl acetate (300 ml) resulted, after distillation of the eluent, in a fraction of indole (1.75 g and purity 95%), with a yield of 4.8% relative to the starting distillate.

Further elution with 1:1 cyclohexane/ethyl acetate resulted, after distillation of the eluent, in a fraction of quinoline derivatives (3.85 g), with a yield of 10.7% relative to the starting distillate and an indole content of 2%.

The column was regenerated as described earlier (Example 2) and the cycle was repeated many times with equal results.

EXAMPLE 6

As described in Example 3, a coal tar distillate (1.9 kg) which contained 16% tar bases, was applied to a silica gel column (3.1 kg).

Elution with cyclohexane resulted, after distillation of the eluent, in a fraction of aromatic hydrocarbons (1.56 kg) with a yield of 82% relative to the starting distillate. Elution with 1:1 cyclohexane/ethyl acetate resulted, after distillation of the eluent, in a fraction of tar bases (0.29 kg) with a yield of 15% relative to the starting distillate.

After regeneration of the column, as described earlier (Example 2), the cycle was repeated many times with equal results.

EXAMPLE 7

A distillate (3 g) which contained 78% toluene and xylene isomers and 22% pyridine bases was diluted with cyclohexane (1:1 v/v) and applied to a column of silica gel (15 g). Elution with cyclohexane (60 ml) resulted, after distillation of the cyclohexane, in a fraction of toluene and xylene isomers (2.33 g) with a yield of 77.7% relative to the starting distillate and which fraction contained less than 0.01% pyridine bases.

Elution with cyclohexane/ethyl acetate (5:95) resulted, after distillation, in a fraction of pyridine bases (0.64 g) with a yield of 21.3% relative to the starting distillate and which fraction contained less than 0.01% hydrocarbons.

The column was regenerated as described before (Example 2) and the cycle was repeated many times, with equal results.

EXAMPLE 8

As described in Example 3, a tar coal distillate (30 g) containing 15% tar acids (phenol and methyl phenol isomers) was applied to an alumina column (90 g, act II, neutral). The aromatic hydrocarbons were eluted as in Example 3 with 300 ml cyclohexane. This resulted in a neutral hydrocarbon fraction (25.1 g) , with a yield of 83.7% relative to the starting distillate. This fraction contained no tar acids.

Elution with 1:4 cyclohexane/propyl acetate (400 ml) resulted, after distillation, in a fraction of tar acids (4.3 g) with a yield of 14.3% relative to the starting distillate. This fraction contains less than 1% of aromatic hydrocarbons. The column was regenerated as described before (Example 2) and the cycle was repeated with equal results.

I claim:

1. A process for separating polar and non-polar constituents from coal tar distillates, comprising passing said distillates over a separation column together with an eluting agent, which comprises mixing a tar oil distillate with a non-polar solvent, passing this mixture over a separation column which contains a silica gel or alumina stationary phase and eluting with a non-polar solvent, the eluting agent being collected together with the substances dissolved therein, followed by eluting with a more polar eluting agent or with a plurality of eluting agents of increasing polarity, and separately collecting the more polar eluting agent or the plurality of eluting agents of increasing polarity, together with the substances dissolved therein, followed by isolating the substances dissolved in the non-polar solvent and in the polar eluting agent, respectively, utilizing known techniques with the proviso that the polar eluting agent is not a halogenated aromatic hydrocarbon, and that the polarity of the nonpolar solvent and the polar eluting agent provides that a wide range of polarity can be obtained.

2. A process according to claim 1, which comprises using as a more polar eluting agent one or a plurality of mixtures of the non-polar eluting agent and one or a plurality of polar eluting agents.

3. A process according to claim 2, wherein the ratio of the non-polar to the polar solvent ranges from 9:1 to 0:1.

4. A process according to claim 1, which comprises using as a non-polar eluting agent selected from the group consisting of benzene, toluene, n-pentane, n-hexane, n-octane and cyclohexane.

5. A process according to claim 1 which comprises using as a polar eluting agent selected from the group consisting of one or more of an ester,
halogenated aliphatic hydrocarbon,
ether,
nitrile, and
alcohol, or mixtures thereof.

6. A process according to claim 5, wherein the ester is selected from the group consisting of ethyl acetate and propyl acetate;
the halogenated hydrocarbon is selected from the group consisting of methylene chloride, chloroform and dichloroethane;
the ether is selected from the group consisting of tetrahydrofuran and dioxane;
the nitrile is acetonitrile;
the alcohol is selected from the group consisting of methanol, ethanol, n-propanol and isopropanol, and mixtures thereof.

7. A process according to claim 1, wherein the mixing ratio of the coal tar distillate to the non-polar solvent is 10–50% by volume of distillate, based on the solvent.

8. A process according to claim 1, wherein the column charge is 5–60%, based on the mass of the stationary phase in the column and calculated on the amount of original distillate.

9. A process according to claims 1, wherein the elution is carried out at a temperature in the range of 20°–50° C.

10. A process according to claim 1, wherein the regeneration of the column is effected by passing therethrough a non-polar solvent as defined in claim 1.

* * * * *